US008056930B2

(12) United States Patent
Cassidy

(10) Patent No.: US 8,056,930 B2
(45) Date of Patent: Nov. 15, 2011

(54) BOTTLE-CAP IDENTIFICATION SYSTEM

(76) Inventor: William Troy Cassidy, Lafayette, CA (US)

( * ) Notice: Subject to any disclaimer, the term of this patent is extended or adjusted under 35 U.S.C. 154(b) by 890 days.

(21) Appl. No.: 11/881,701

(22) Filed: Jul. 28, 2007

(65) Prior Publication Data

US 2009/0026104 A1 Jan. 29, 2009

(51) Int. Cl.
*B42D 15/00* (2006.01)

(52) U.S. Cl. ..... 283/100; 283/67; 283/70; 283/94; 215/230; 40/310; 40/311

(58) Field of Classification Search ..... 215/230; 206/459.1, 459.5, 807; 40/310, 311; 283/72, 283/94, 100, 101, 102, 67, 70
See application file for complete search history.

(56) References Cited

U.S. PATENT DOCUMENTS

| | | | | |
|---|---|---|---|---|
| 5,992,892 | A * | 11/1999 | Schaefer et al. | 283/81 |
| 6,745,505 | B2 * | 6/2004 | Moran | 40/311 |
| 2002/0190115 | A1 * | 12/2002 | Schuren et al. | 229/400 |
| 2007/0028491 | A1 * | 2/2007 | Panella | 40/324 |

FOREIGN PATENT DOCUMENTS

JP 2005075427 A * 3/2005

* cited by examiner

*Primary Examiner* — Dana Ross
*Assistant Examiner* — Pradeep C Battula
(74) *Attorney, Agent, or Firm* — Matlock Law Group, PC

(57) ABSTRACT

A bottle-cap identification system includes a double or, alternatively, single layer coating applied to top and sides of a twist-top bottle cap and its appendant stationary connection ring. The double layer coating consists of an inner colored painting with stripe pattern and an outer opaque black layer. The single layer coating includes only the opaque substance and is applied directly to a cap and ring, whereby the cap and ring is either of solid color or features the genuine brand design. The black layer is composed of a polymer with weaker cohesive than adhesive bonds, which prevents the color of cap and ring from being seen through and enables its removal by scratching. Such scratching results in a marking randomly exposing the inner layer or, respectively, the cap and ring itself. The marking and its alignment on cap and ring serve as criterion for recognition and identification of the bottle.

22 Claims, 6 Drawing Sheets

BOTTLE-CAP IDENTIFICATION SYSTEM

BACKGROUND OF THE INVENTION

The present invention relates generally to a bottle-cap identification system and more particularly to a personalized and individualized bottle-cap identification. Specifically this invention relates to a user removing a portion of an outer black layer from the cap and the ring by scratching through it, exposing either the inner colored layer or the multi colored bottle cap and connection ring. Further, the subject matter also relates generally to a means for providing personalized bottle-cap identification.

Traditional bottle-cap identification systems are well known in the art. The following patents reflect the state of art of which Applicant is aware and is included herewith to discharge Applicant's acknowledged duty to disclose prior art. It is respectfully stipulated, however, that none of the patents teach singly nor render obvious when considered in an inconceivable, permissible combination, the nexus of the instant invention as described herein after and as particularly claimed.

In some published patents, existing systems are shown ranging from a bottle, bottle cap or can with a preprinted marking or symbol. To use these types of inventions, a person must indicate one of the symbols usually through a pointing mechanism or other means. Four of the patents, U.S. Pat. Nos. 4,753,189; 6,834,763; 5,799,815; 6,868,627 and 6,745,505 collectively seem to appear to reflect the commonly understood structure associated with a Bottle-Cap Identification System.

One patent discloses a medicine bottle having a closure for indicating dosage and other information which changes automatically as the closure is rotated on the bottle of the unit.

Another patent discloses a personal identification method and system for improving personal hygiene in which provision is made for identifying a beverage, food product, or the like, with a particular person so that another person does not inadvertently access the identified item unintentionally. This invention is not limited to bottle caps but to food and beverages in general.

Further, a device for identifying an individual pop-top can having a pull tab for levering open the can was patented. The device includes a flexible resilient sleeve of plastic or rubber which slides over the free end of the pop-top can tab. Additionally, there is a patent that discloses a can with a movable tab that can be used to point to different symbols as a way to indicate which can is yours. The example in the patent shows a movable tab that can be pointed to sport logos.

The last patent in this field discloses a Color Coded Beverage Cap Collection with permanent passive indicia indicating beverage bottle user identities. The color-coded bottle caps are used as the actual caps for conventional beverage bottles. The color-coded caps do not add cumulative indicia to the bottle caps, in additional to pre-existing indicia, such as brand name logos, on the bottle caps.

Though all of these progenitors have a similar purpose and identify the bottle or its user, none of them is exactly on point of the Applicant's invention. For example, these devices fail to allow the user to create his or her coincidentally or purposefully marking. Additionally, these devices use different methods to facilitate the identification of the bottle.

The present invention relates generally to an improved bottle cap identification system and more particularly to a bottle cap itself being manufactured using multiple colored plastic, arranged in stripes. Covering the inner multiple colored plastic layer, is the outer layer of a solid application of black paint, easily fractionally removable by scratching, or scuffing. The outer-black layer completely covers the inner-colored layer in its entirety and is opaque.

The outer-black layer is intended to be partially removed by scratching through this layer, exposing the inner-colored surface below. The randomness of the scratched outer black layer coupled to the exposed inner-colored layer uniquely identifies a bottle cap among similar bottle-caps.

An alternative to the bottle cap itself being manufactured using multiple colored plastic (arranged in stripes) is a multilayered substance applied to the top, side, and the connection ring of a twist-top bottle cap. The inner layer is a solid application of stripes of brightly colored paints, durable against peeling, scratching, or scuffing. The inner-colored layer is intended to be permanently affixed to the top of the twist-top bottle cap. Covering the inner-colored layer is the outer layer of a solid application of black paint, easily removable by scratching, or scuffing. The outer-black layer completely covers the inner-colored layer in its entirety and is opaque.

One problem with such a system is that the outer layer could become scuffed or scratched inadvertently during the manufacturing, packaging, transport, or distribution process. If this condition occurs there is the possibility that multiple caps could be sold in a "pre-scratched" condition whereby the bottle-cap is considered un-disguisable. This issue could be mitigated by applying a thin plastic membrane over the top of the bottle-cap making it more unlikely that the outer-black layer would inadvertently become scratched of scuffed. This thin plastic membrane is commonly found on computer screens, watch faces, and stereo equipment displays in their packaged state. It is designed to be easily removed with just your fingers. However, if a certain type of polymer is used, such unintended scratching is unlikely to happen.

Another problem in such a system is that after the bottle cap is dislodged from the connection ring there might be the possibility that the scratch mark that extended from the bottle cap's side onto the connection ring directly below no longer line up to appear as a continues band of scratch mark. This might reduce the ability to quickly determine which container aligns with caps scratched in a similar manner. Thus, it is important to insure that the connection ring remains stationary on the neck of the bottle once the seal between bottle cap and the connection ring is broken.

In case the connection ring is being dislodged identification is still possible. Almost like tumblers in a safe lock the user can spin the connection ring to ultimately line up the marking of ring and cap.

Providing a bottle cap identification system where the randomness of the outer layer is coupled to an exposable inner-colored layer to uniquely identify one particular bottle cap among many similar bottle caps, thus allowing a user a more useful way to identify their own bottle of consumer product from a plurality of other consumer containers with bottle caps.

The obvious problem that the bottle cap identification system solves is the ability to easily personalize and distinguish two identical containers by their bottle caps. The benefit of this solution is personal hygiene and public health. With the increase in the prevalence of world health issues like AIDS, ARC, SARS, and TB the ability to identify someone else's container form you own container becomes immediately clear. Therefore it is desirable to provide such an improved system that overcomes the above and other problems.

BRIEF SUMMARY OF THE INVENTION

The present invention provides a bottle cap identification system, the user to remove a portion of the outer black layer from the cap and the ring by scratching through it, exposing either the inner colored layer or the multi colored bottle cap and connection ring. The randomness of the scratched outer black layer and the resulting exposed inner colored layer or bottle cap and connection ring uniquely identifies a bottle cap.

In a preferred embodiment of the present invention, an improved bottle cap identification system is disclosed wherein a method identifying an owner is performed within the owner's individual bottle cap related to the owner's consumable product.

According to one aspect of the present invention, the scratched bottle cap and connection ring, when affixed to a container, identifies the owner of the container by the association of the bottle cap, the connection ring, and the container.

According to another aspect of the present invention, the scratched bottle cap and connection ring, when affixed to a container, identifies the contents of the container by the association of the bottle cap, the connection ring, and the container.

According to yet another aspect of the present invention, the scratched bottle cap and connection ring, when affixed to a container, identifies the age of the container by the association of the bottle cap, the connection ring, and the container.

According to another aspect of the invention, the non-scratched bottle cap also identifies the owner, contents and age of the container. Thus, for example, three people are consuming three drinks in identical containers. Two of three use the bottle-cap identification system to mark their containers, while the third does not. In this context the each container can be identified with an individual owner, two by their markings and the third by leaving the covering layer intact.

One object of the invention is that it allows the bottle cap to be marked without the use of a tool typically used for such a purpose (pen, marker, etc). This invention directly embeds the marking capability into the manufacturing process of the bottle cap. The consumer can mark the bottle with his or her teeth, fingernail, or toenail. Because of the randomness of the scratched surface and the color exposed below the likelihood of two caps being marked the same way is remote at best.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

DETAILED DESCRIPTION OF THE INVENTION

Figure 1:
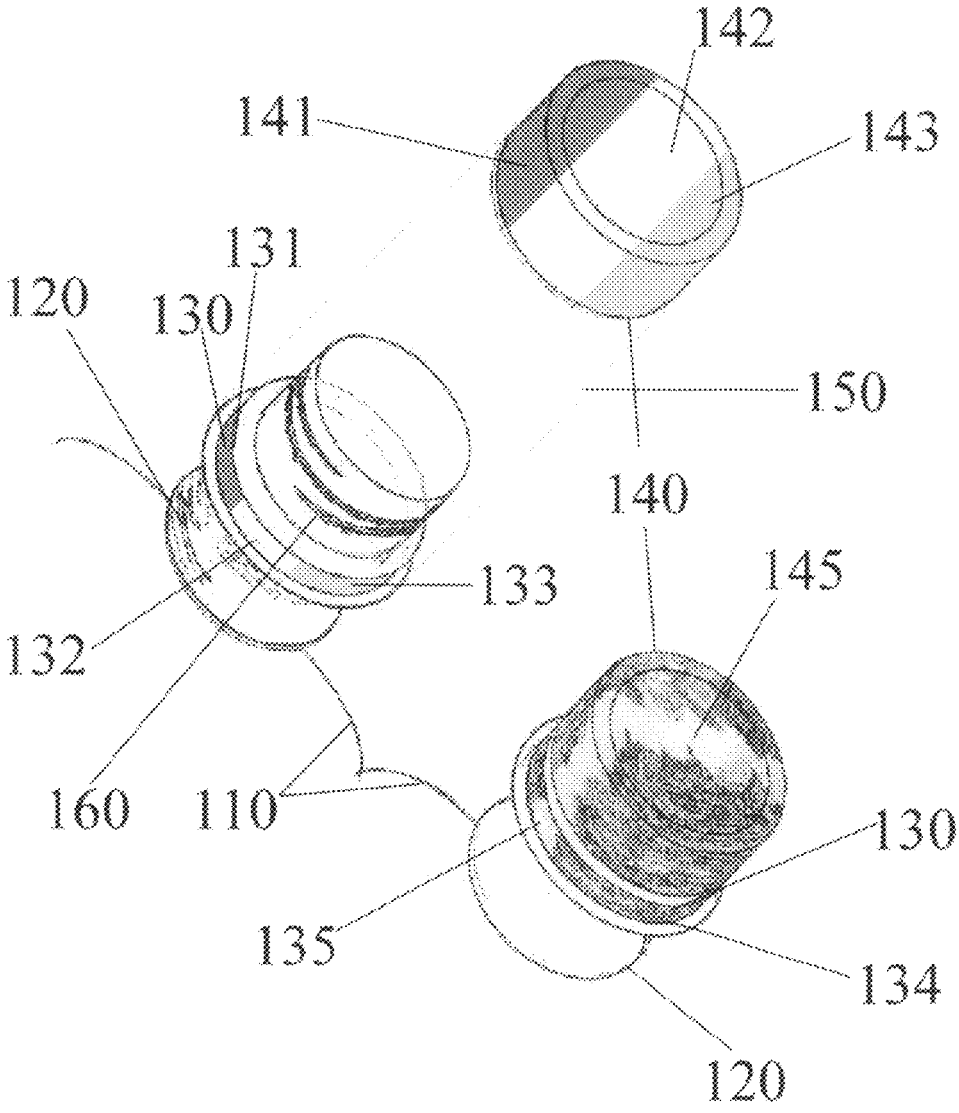
FIG. 1 illustrates the Multilayered Manufacturing Approach lateral top view.

The present invention provides a multi-layered bottle cap identification system for all twist-top bottles 110. A multi-layered coating is applied to the top and sides of a twist-top bottle cap 140 and to the bottle cap connection ring 130.

The connection ring, located along the circumference of the bottle's spout 120, just below the bottle's cap 140 is permanently affixed to the neck of the bottle. Once the seal between bottle cap and connecting ring is broken, the ring does not revolve.

The coating's inner layer is a painted substance using a pattern composed of the three primary colors each in a separate sector. The sectors are determined by finding and dividing the diameter along the top bottle cap into three equal parts, then running a pair of parallel lines perpendicular to the diameter where either two of the equal measurements meet. The result is parallel stripes, each the same width at their widest point and of a single color, running along the top and side of the bottle cap and the ring. The median one is comparatively long and broad in relation to the two other sectors at either side.

Each sector is colored one of the three primary colors along the top and side of the bottle cap continuing to the connection ring directly below the cap's bottom edge. The connection ring maintains the color and boundary of the ring directly above its top most edge. The first stripe of the cap is red 141, the median one yellow 142, and the last, right one is blue 143. The first stripe of the ring is red 131, the median, diagonally arranged stripes are yellow 132, and the last, right stripe is blue 133.

Figure 2:
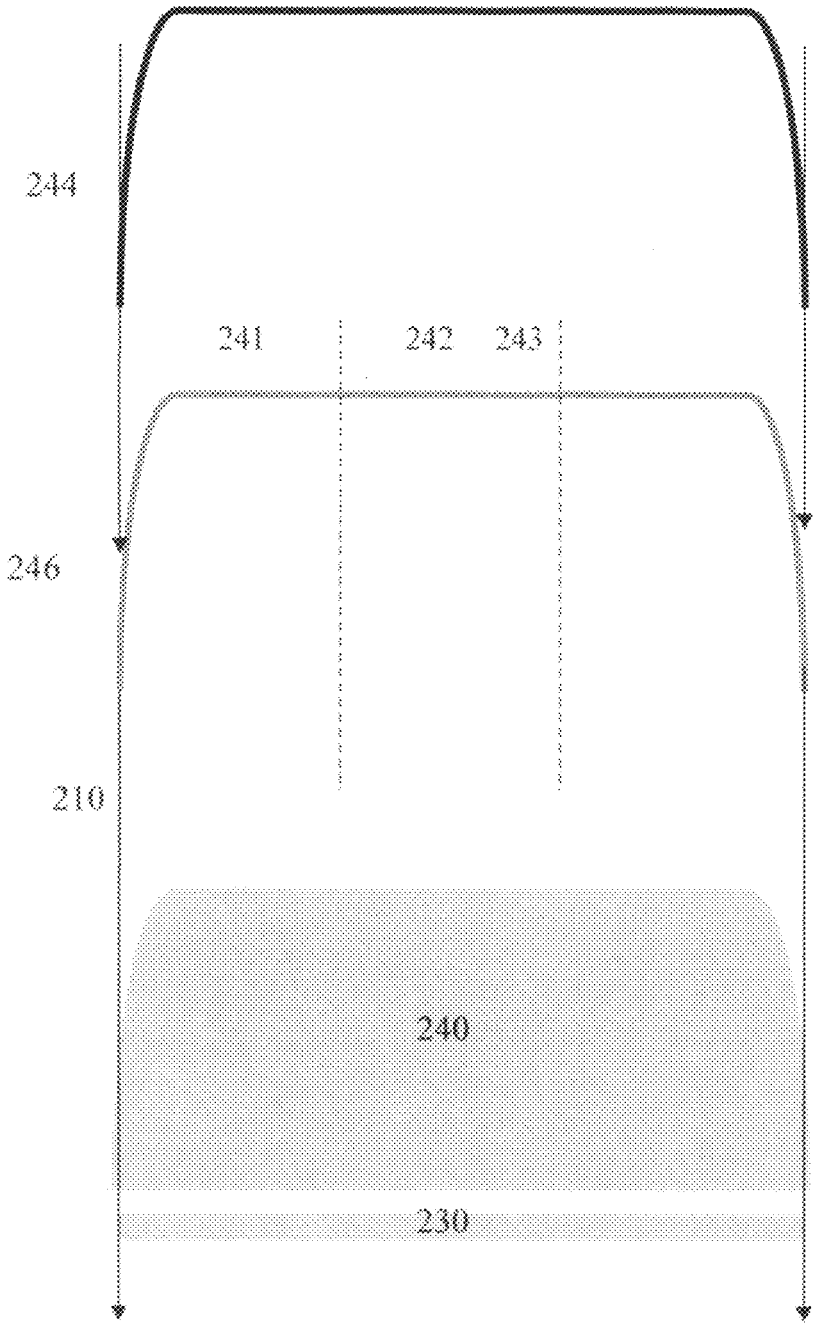
FIG. 2 depicts the application of the inner and outer layer on cap and ring of the bottle.

More specifically, as shown in FIG. 2, the paint of the inner layer 246 must be applied to cap 240 and ring 230 in such a way that they remain indelible 210. It is intended to be permanently affixed to the bottle cap 240 and the connection ring 230. Numerous processes are well known in the art to achieve such an effect. The paint must be durable, impervious to scratching, scuffing, or abrasions. The substance used must be durable against peeling, scratching, or scuffing.

The colored inner layer 246 is coated with an outer layer 244. It covers the entire side and top of the cap 240 as well as the ring 230. The outer layer is a solid application of a black substance completely covering the inner-colored layer along the entire bottle cap 240 and connection ring 230.

The above described outer layer 244 substance is comprised of black paint capable of completely hiding the inner layer paint 246 applied to the bottle cap 240 and the connection ring 230 below. This opaque substance prevents the color pattern 241, 242, 243 from being seen through. It is well known in the art that the opaque substance 244 is made out of a special adhesive polymer that can be removed through the torque exerted on them through the friction of rubbing.

This can be done by scratching or scuffing of a fingernail, a paper clip, or another similar object. The direct application of force cannot remove the coating which guarantees that it remains intact during typical transport and storage activities.

This pressure partially removes the outer black layer and exposes the inner colored surface below. The markings may extend from the ring 230 over the cap 240 to an end point on the remote side of the ring.

Figure 3:
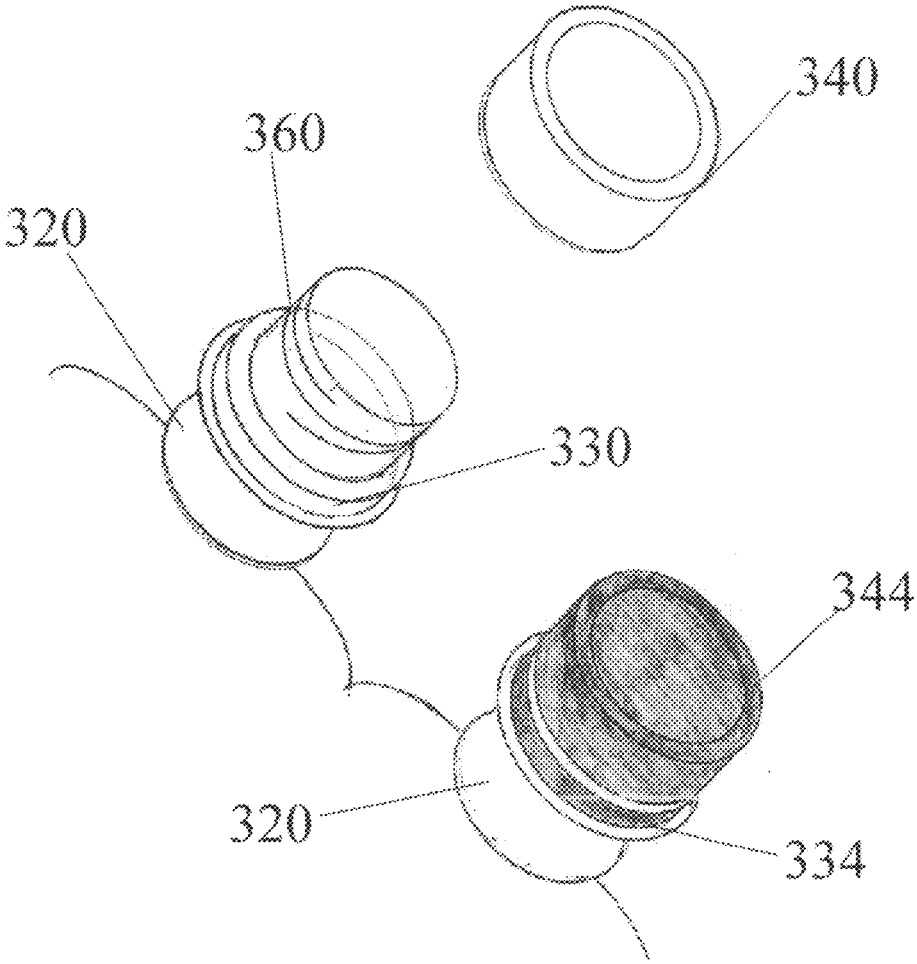
FIG. 3 illustrates the Single Manufacturing Approach lateral top view.
Figure 4:
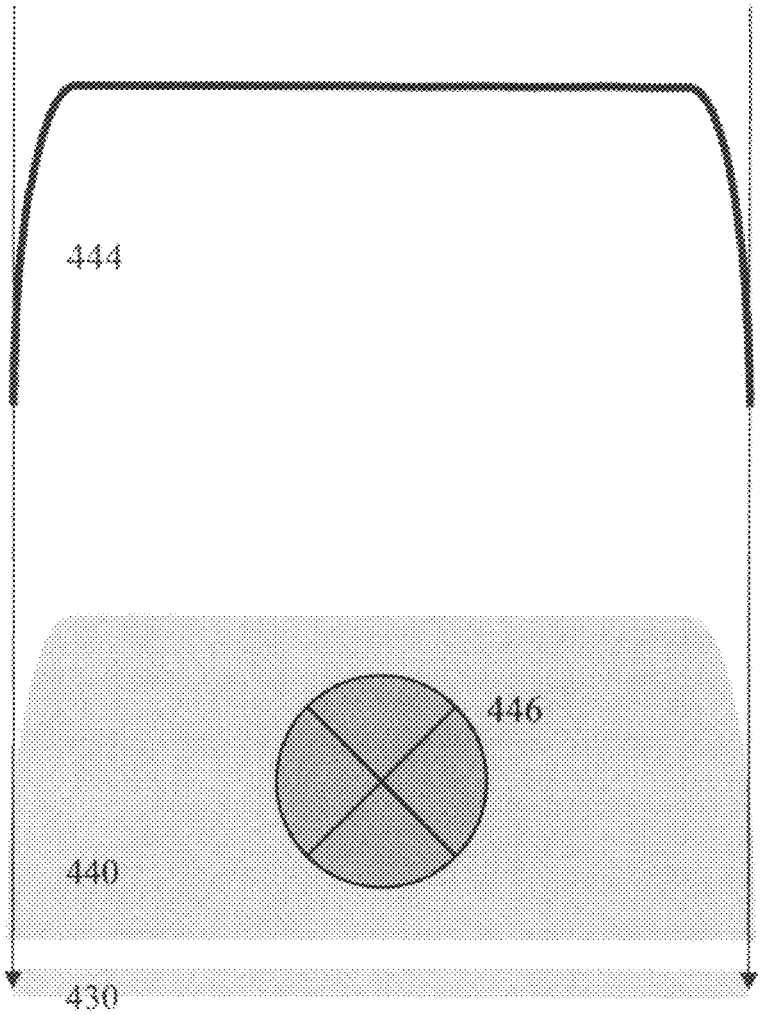
FIG. 4 shows another embodiment of the single layer bottle cap identification system wherein the opaque substance is applied to a generic brand bottle cap and ring.

Another embodiment of the invention is the single layer bottle cap identification system shown in FIGS. 3 and 4. In one embodiment of this system, FIG. 3, a single-layered substance 344 is applied to the top and sides of a twist-top bottle cap 340 and to the bottle cap connection ring 330, located along the circumference of the bottle's spout 320, just below the bottle's thread 360 and is permanently affixed.

The bottle cap and the connection ring used thereby are of a solid color or clear, and, thus, different from the outer-layer paint. The materials used to manufacture these kinds of caps and rings also have to be durable against peeling, scratching or scuffing. Is it well known in the art that the materials used therefore are durable against peeling, scratching, or scuffing.

In another aspect of the single-layer bottle cap identification system, the, solid, opaque substance 444 is applied completely and directly on the bottle cap and connection ring, whereby the twist-top bottle cap 440 and ring 430 are manufactured with the generic brand emblem 446. The opaque substance, again, prevents the color of cap and ring underneath, from being seen through.

The painted, opaque layer of the single and the multiple-layer system can be removed by scratching or scuffing through this layer, exposing the system's typically colored bottle cap and connection ring below.

The consumer can use a finger nail, paper clip, key, or similar object to scratch the surface of the outer layer of the bottle cap and the connection ring to tear off and partially remove it. This exposes a unique outline and area of the inner layer, the brand emblem or the solid colored bottle cap and connection ring.

Such fractional skinning is facilitated by designing the polymer with weaker cohesive bonds which are holding the latex to itself than adhesive bonds which are holding the latex to the inner layer on which it is applied.

Thus, the coating cannot be removed in a normal way without damaging it. It is well known in the art that the only way to completely, without marring, remove the polymer is through a chemical wash. A mild calcium bicarbonate solution which has a pH of about 5.9 weakens the adhesion of the polymer to the inner layer and renders it possible to scrape off the latex.

Figure 5:
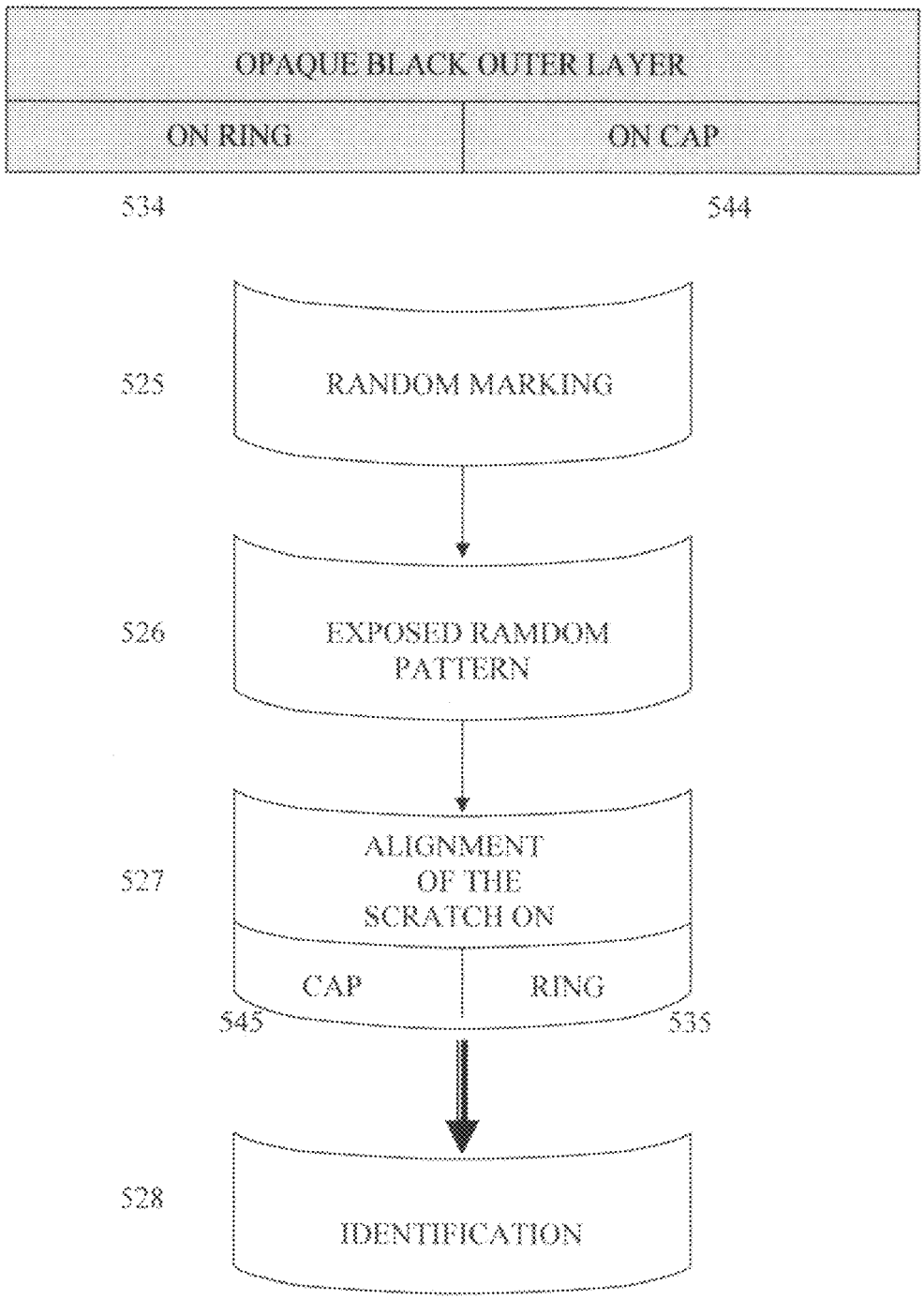
FIG. 5 is a flowchart of the marking and recognition process.

FIG. 5 illustrates the recognition process. The randomness of the markings 525 in the opaque layer applied to the bottle's ring 534 and cap 544 and the thereby exposed random pattern 526 on the inner colored layer or, respectively, the cap itself, will allow the bottle cap to be differentiated from other similar bottle caps in both a scratched and non-scratched state. In the scratched state the marks on ring and cap always align 527 and make recognition possible 528.

It directly correlates the container and the bottle cap in several fundamental ways. The scratched cap while affixed to a container identifies a particular container from other containers which are not scratched.

Figure 6:
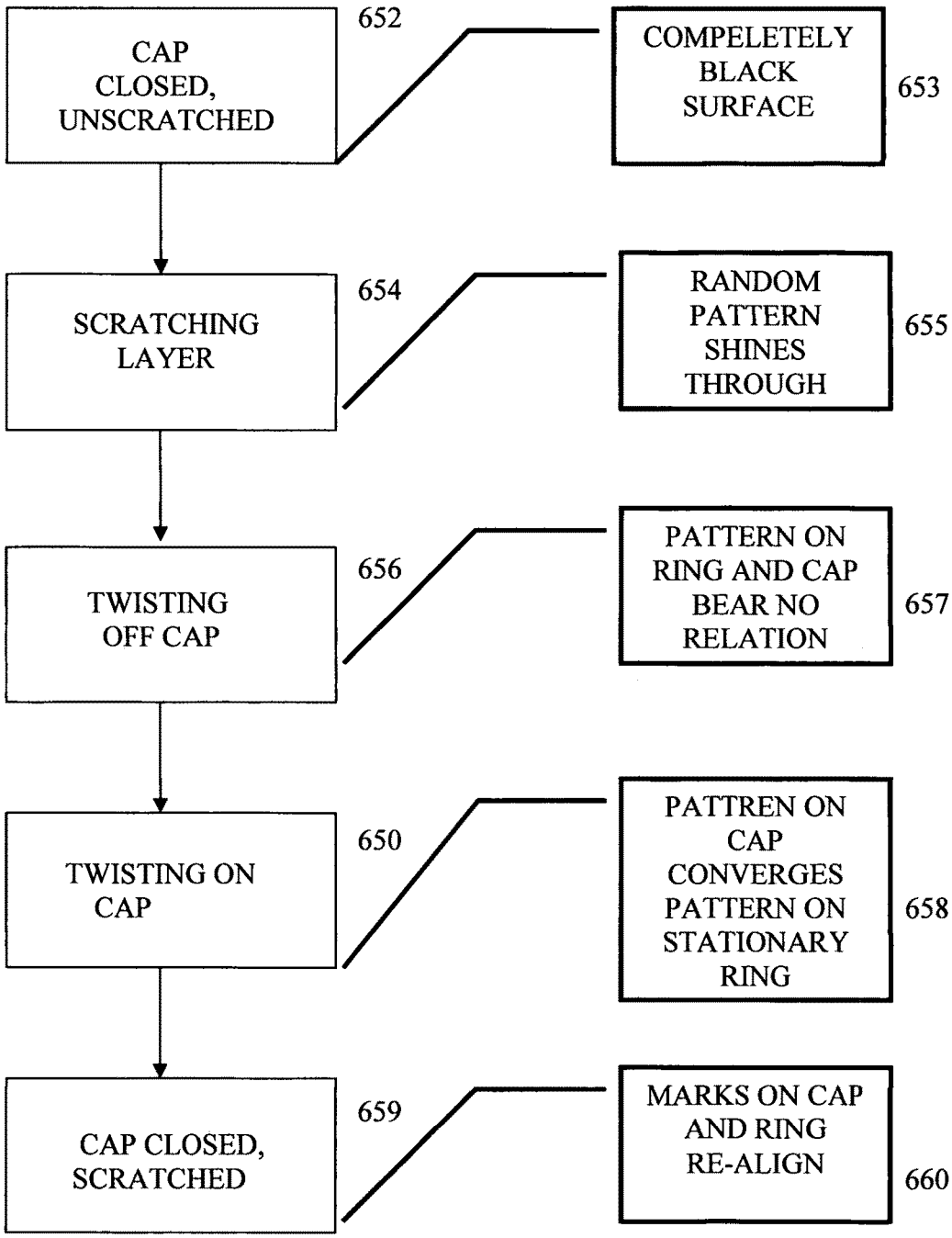
FIG. 6 is a flowchart depicting a method of twisting off and on the bottle cap.

Another aspect of the invention is the opening 656 and re-closing process 650 of the bottle and the thereby re-evoked alignment of the scratch along the side of the cap and the connection ring below the bottom of the cap, shown in FIG. 6.

The method of twisting the cap off the threads of the neck of the bottle to remove the bottle cap from the bottle 656 is well known in the art just like the method of placing and twisting on the coated cap 650 in order to close the bottle. One object of the invention, shown in FIG. 6, is that after screwing on the cap the scratch mark that extended over cap and ring is lined up again and appears as a continuous band of scratch marks.

This is facilitated by several special qualities of the bottle cap identification system. In the closed, unscratched state 652, merely a unscathed black surface is apparent 653. When the layer sustains scratches 654 a random pattern appears through the black layer 655 and it is parted when the bottle cap is twisted off 656. After screwing on the cap 650, however, the scratch mark that extended over cap and ring is lined up again 660, in particular, because the connection ring remains stationary on the neck of the bottle once the seal between bottle cap and ring is broke. Accordingly by twisting on the cap 650 the pattern on cap and ring converge each other 658 and in the closed state the marks still appear as a continuous bands of scratch marks.

Just as in the starting position, similar to FIG. 1, the covered red stripe of the cap 141 matches up with the red stripe on the ring 131, the yellow median stripe of the cap 142 matches up with a yellow stripe on the opposite sides of the ring 132, the blue, right stripe on the cap 143 matches up with the blue part on the ring 133 after screwing up, removing the cap and re-closing it. By twisting the cap on the winding of the thread the cap is brought back in the same position with the ring as it was before the seal was broken.

The scratched cap and connection ring, when affixed to a container, correlates the container and the bottle cap in several fundamental ways and, thus, provides several feasibilities for identification. The Association of the two objects can be used to determine the owner or customer, the content of the container or the age of the container and/or contents.

While the invention has been described by way of example and in terms of the specific embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An identification bottle cap system, comprising:

a twist-top bottle cap, a stationary connection ring fully breakably connected direct below said twist-top bottle cap and adapted to be affixed to a neck of a twist-top bottle, wherein said connection ring does not revolve once said twist-top bottle cap is broken off from said connection ring, and a coating applied to top and sides of said twist-top bottle cap and to said stationary connection ring, wherein said coating comprises:

an inner indelible layer of substance permanently affixed to said bottle cap and said stationary connection ring, an outer opaque layer covering said inner indelible layer, wherein said outer opaque layer is capable of being fractionally removed by scratching to expose said inner layer resulting in a random mark on said coating, and wherein said outer opaque layer comprises a polymer with weaker cohesive bonds which are holding the latex to itself than adhesive bonds which are holding the latex to the inner layer on which it is applied, and wherein said coating is capable of being marked to provide for identification of:

the contents, and the age of the container.

2. The identification bottle cap system of claim 1, further comprising:

a thin plastic membrane applied over said coating applied to the top, sides of said twist-top bottle cap and to said stationary connection ring.

3. The identification bottle cap system of claim 2, further comprising an inner layer wherein a multiple-colored paint is arranged in parallel stripes, said stripes having the same width.

4. The identification bottle cap system of claim 3, further comprising an inner layer wherein said stripes are of three different primary colors.

5. The identification bottle cap system of claim 3, further comprising an inner layer wherein said stripes are applied to the entire outer surface of the cap.

6. The identification bottle cap system of claim 2, further comprising an outer layer of removable substance.

7. The identification bottle cap system of claim 2, further providing for scratching of the outer opaque layer by an edged object exposing a unique outline and area of material thereunder.

8. The identification bottle cap system of claim 1, wherein said twist-top bottle cap and said stationary connection ring further provide for alignment of scratch marking in said coating when said cap is screwed on.

9. The identification bottle cap system of claim 1, further comprising a marking for providing randomness, recognition and bottle differentiation.

10. The identification bottle cap system of claim 1, further comprising a marking providing for identification of:

the owner.

11. The identification bottle cap system of claim 1, wherein said outer opaque layer cannot be removed without being damaged.

12. The identification bottle cap system of claim 1, wherein said outer opaque layer can be removed through a chemical wash in a mild calcium bicarbonate solution.

13. An identification bottle cap system comprising:

a twist-top bottle cap, a stationary connection ring fully breakably connected directly below said bottle cap and adapted to be affixed to a neck of a twist-top bottle, wherein said connection ring does not revolve once said twist-top bottle cap is broken off from said stationary connection ring, a coating comprising a single-layer of opaque substance applied directly to top and sides of said twist-top bottle cap and to said stationary connection ring, wherein said single-layer of opaque substance is capable of being fractionally removed by scratching to expose said bottle cap and connection ring resulting in a random mark.

14. The identification bottle cap system of claim 13, wherein said twist-top bottle cap and stationary connection ring are manufactured with a generic brand emblem.

15. The identification bottle cap system of claim 13, wherein said twist-top bottle cap and said stationary connection ring are clear or of a solid color different from the color of said coating.

16. The identification bottle cap system of claim 13, further providing for scratching of said coating by an edged object exposing a unique outline and area of material thereunder.

17. A method for implementing a bottle-cap identification system, comprising providing a bottle cap system including a twist-top bottle cap, a stationary connection ring fully breakably connected directly below said bottle cap and adapted to be affixed to a neck of a twist-to bottle wherein said connection ring does not revolve once said twist-top bottle cap is broken off from said stationary connection ring, and recognition by a random marking, in a removable outer layer, and exposing a random pattern of an underneath inner layer or of the cap itself whereby a mark on said ring and cap align when the cap is screwed on, wherein the random marking provides for identification of the owner of the container, the contents of the container, or the age of the container.

18. The method of claim 17, further comprising the following steps:

displaying a completely black surface of cap and ring when both parts are unscratched, twisting off the bottle cap and, thereby, parting the placed marks that extend over cap and ring, and twisting on the bottle cap and aligning these marks again.

19. An identification bottle cap system for a twist-top bottle, comprising:

a twist-top bottle cap for said twist-top bottle, a stationary connection ring fully breakably connected directly below said bottle cap and adapted to be affixed to a neck of said twist-top bottle, wherein said connection ring does not revolve once said bottle cap is broken off from said connection ring, and a coating applied to top and sides of said twist-top bottle cap and to said stationary connection ring, wherein said coating comprises:

an inner indelible layer of substance permanently affixed to said bottle cap and said stationary connection ring, and an outer opaque layer covering said inner indelible layer, wherein said outer opaque layer is capable of being fractionally removed by scratching to expose said inner layer resulting in a random mark on said coating, wherein said twist-top bottle cap and said stationary connection ring provide for alignment of scratch marking in said coating when said cap is screwed on.

20. The identification bottle cap system of claim 19, wherein said inner indelible layer of substance comprises a multiple-colored paint arranged in parallel stripes, said stripes having the same width.

21. The identification bottle cap system of claim 20, wherein said stripes are of three different primary colors.

22. The identification bottle cap system of claim 20, wherein said stripes are applied to the entire outer surface of said cap and said stationary ring.

* * * * *